US012571544B2

(12) United States Patent
Rosén et al.

(10) Patent No.: US 12,571,544 B2
(45) Date of Patent: Mar. 10, 2026

(54) METHOD AND AN APPARATUS FOR DETERMINING A DEVIATION IN A THERMAL ENERGY CIRCUIT

(71) Applicant: E.ON SVERIGE AB, Malmo (SE)

(72) Inventors: Per Rosén, Lund (SE); Jacob Skogström, Lomma (SE); Fredrik Rosenqvist, Helsingborg (SE); Bengt Lindoff, Bjarred (SE)

(73) Assignee: E.ON SVERIGE AB, Malmo (SE)

( * ) Notice: Subject to any disclaimer, the term of this patent is extended or adjusted under 35 U.S.C. 154(b) by 1198 days.

(21) Appl. No.: 17/310,652

(22) PCT Filed: Feb. 20, 2020

(86) PCT No.: PCT/EP2020/054414
§ 371 (c)(1),
(2) Date: Aug. 16, 2021

(87) PCT Pub. No.: WO2020/169699
PCT Pub. Date: Aug. 27, 2020

(65) Prior Publication Data

US 2022/0349589 A1 Nov. 3, 2022

(30) Foreign Application Priority Data

Feb. 21, 2019 (EP) ..... 19158428

(51) Int. Cl.
*F24D 10/00* (2022.01)
*F24D 19/10* (2006.01)

(52) U.S. Cl.
CPC ..... *F24D 10/00* (2013.01); *F24D 19/1003* (2013.01)

(58) Field of Classification Search
None
See application file for complete search history.

(56) References Cited

U.S. PATENT DOCUMENTS 4,883,087 A * 11/1989 Nielsen ..... G01M 3/2807 73/40.5 R
7,792,659 B2 * 9/2010 Yliniemi ..... F24D 10/00 702/182

(Continued)

FOREIGN PATENT DOCUMENTS

CN 101427033 A 5/2009
CN 107989914 A 5/2018

(Continued)

OTHER PUBLICATIONS

International Search Report and Written Opinion of PCT/EP2020/054414, Dated May 20, 2020 in 9 pages.

*Primary Examiner* — Edelmira Bosques
*Assistant Examiner* — Deepak A Deean
(74) *Attorney, Agent, or Firm* — Knobbe , Martens, Olson & Bear, LLP

(57) ABSTRACT

A method for identifying a deviation in a thermal energy circuit is presented. The method comprising: receiving (302) a first hot fluid flow measurement (f1) from a first hot fluid flow sensor (208) arranged in a hot fluid conduit (102); receiving (304) a first cold fluid flow measurement (r1) from a first cold fluid flow sensor (204) arranged in a cold fluid conduit (104); receiving (306) a second hot fluid flow measurement (f2) from a second hot fluid flow sensor (210) arranged in the hot fluid conduit (102) upstream the first hot fluid flow meter (208); receiving (308) a second cold fluid flow measurement (r2) from a second cold fluid flow sensor (206) arranged in the cold fluid conduit (104) downstream the first cold fluid flow sensor (204); receiving (310) a thermal device flow measurement (g) from a thermal device flow sensor (202) configured to measure a thermal device flow of a thermal device (106*a*) connected to the hot fluid conduit (102) downstream the first hot fluid flow sensor (208) and upstream the second hot fluid flow sensor (210), (Continued)

and to the cold fluid conduit (104) upstream the first cold fluid flow sensor (204) and downstream the second cold fluid flow sensor (206). The method further comprising upon (312) the first hot fluid flow measurement (f1) is different from the second hot fluid flow measurement (f2) and the thermal device flow measurement (g) in combination, generating (314) a first deviation signal indicating a deviation in the hot fluid conduit (102), or upon (316) the first cold fluid flow measurement (r1) is different from the second cold fluid flow measurement (r2) and the thermal device flow measurement (g) in combination, generating (318) a second deviation signal indicating a deviation in the cold fluid conduit (104).

13 Claims, 5 Drawing Sheets

(56) References Cited

U.S. PATENT DOCUMENTS

| | | | | |
|---|---|---|---|---|
| 9,835,385 | B2 * | 12/2017 | Ebster | F24D 10/00 |
| 11,118,790 | B2 * | 9/2021 | Rosén | F24D 11/00 |
| 11,927,930 | B2 * | 3/2024 | Rosén | G06Q 10/063 |
| 2004/0153280 | A1 * | 8/2004 | Lindgren | F24D 19/1051 702/130 |
| 2005/0081507 | A1 * | 4/2005 | Tumelty | F01D 25/20 60/39.08 |
| 2006/0287837 | A1 * | 12/2006 | Garnaes | G01M 3/2807 702/51 |
| 2008/0281763 | A1 * | 11/2008 | Yliniemi | F24D 19/1081 374/E17.01 |
| 2010/0045470 | A1 * | 2/2010 | Araiza | F24D 1/02 700/282 |
| 2012/0279681 | A1 * | 11/2012 | Vaughan | F24D 10/003 165/96 |
| 2013/0197833 | A1 * | 8/2013 | Israeli | G01M 3/2815 702/51 |
| 2015/0083362 | A1 * | 3/2015 | Liu | F24D 17/0005 165/45 |
| 2017/0037604 | A1 * | 2/2017 | Allmaras | G05B 17/02 |
| 2018/0259196 | A1 * | 9/2018 | Rosén | F24D 19/1069 |
| 2018/0259197 | A1 * | 9/2018 | Rosén | F24D 10/003 |
| 2019/0011136 | A1 * | 1/2019 | Rosén | F24D 10/003 |
| 2021/0293417 | A1 * | 9/2021 | Rosenqvist | F24D 19/1006 |

FOREIGN PATENT DOCUMENTS

| | | | |
|---|---|---|---|
| CN | 207675241 | U | 7/2018 |
| CN | 108603667 | A | 9/2018 |
| CN | 108603668 | A | 9/2018 |
| WO | WO 87/04520 | A1 | 7/1987 |
| WO | WO 2012/136209 | | 10/2012 |
| WO | WO 2017/108561 | | 6/2017 |

* cited by examiner f1=f2+g 212 r1=r2+g 214 f1=f2+g+l1 218 r1=r2+g 220 f1=f2+g 226 r1=r2+g+l2 224 f1=f2+g+b 228 r1=r2+g+b 230

METHOD AND AN APPARATUS FOR DETERMINING A DEVIATION IN A THERMAL ENERGY CIRCUIT

FIELD OF THE INVENTION

The invention generally relates to a method for identifying a deviation in a thermal energy circuit in a combined district heating and cooling system.

BACKGROUND OF THE INVENTION

Today, it is common practice in many parts of the world to provide heating and hot water for houses and buildings via an energy grid. One example of such energy grid is a district heating grid comprising a system of conduits and valves for distributing hot water to the houses and buildings such that the houses can be heated when needed. Alternatively, according to another example, instead of using hot water for providing space heating, gas may be provided to the houses and buildings via the system. By having access to gas, typically a fossil fuel gas, the houses can be heated by using a gas burner. In addition to space heating, the hot water or the gas may be used for preparing hot tap water.

A drawback is that the water used in classical district heating systems may be very hot, sometimes close to 100 degrees Celsius. In case of a leakage, this may constitute a serious safety issue.

To cool the houses and buildings, similar systems may be used. The general principle of these systems is however the opposite. Instead of providing heat by e.g. providing hot water, heat is collected in the houses and transported away from the houses. District cooling grids, that is, networks of conduits and valves connecting several real estates for cooling purposes, using water as heat carrier are however still rare. The common practice is instead to use electrical energy for running air conditioning systems, which is a disadvantage at least from an environmental perspective.

Examples of using combined district heating and cooling systems are known. For instance, in WO2017/108561 A1 filed by E.ON Sverige AB. These combined systems utilize heat pumps for energy efficient heating and cooling of buildings.

Even though it is today known to use combined district heating and cooling systems to provide space heating as well as space cooling, these can be further improved. One area of improvement is efficient system maintenance. For instance, if being able to easily and quickly being able identify deviations, a down time for service may be lowered. This would improve an overall performance of the systems.

SUMMARY OF THE INVENTION

It is an object of the present invention to solve at least some of the problems mentioned above.

According to a first aspect, a method for identifying a deviation in a combined district heating and cooling system (100) comprising a thermal energy circuit is provided. The thermal energy circuit comprises a hot fluid conduit for transporting hot fluid, a cold fluid conduit for transporting cold fluid, and at least one thermal device connected to the hot fluid conduit via a hot fluid connection conduit and to the cold fluid conduit via a cold fluid connection conduit, wherein, during operation, the hot fluid is warmer than the cold fluid. The method comprising: receiving a first hot fluid flow measurement from a first hot fluid flow sensor arranged in the hot fluid conduit; receiving a first cold fluid flow measurement from a cold fluid flow sensor arranged in the cold fluid conduit; receiving a second hot fluid flow measurement from a second hot fluid flow sensor arranged in the hot fluid conduit upstream the first hot fluid flow sensor; receiving a second cold fluid flow measurement from a second cold fluid flow sensor arranged in the cold fluid conduit downstream the first cold fluid flow sensor; and receiving a thermal device flow measurement from a thermal device flow sensor configured to measure a thermal device flow of a thermal device connected to the hot fluid conduit downstream the first hot fluid flow sensor and upstream the second hot fluid flow sensor, and connected to the cold fluid conduit upstream the first cold fluid flow sensor and downstream the second cold fluid flow sensor. The thermal device flow of the thermal device is a flow either from the cold conduit across the thermal device to the hot conduit or from the hot conduit across the thermal device to the cold conduit. The method further comprises: upon the first hot fluid flow measurement is different from the second hot fluid flow measurement and the thermal device flow measurement in combination, generating a first deviation signal indicating a deviation in the hot fluid conduit; and/or upon the first cold fluid flow measurement is different from the second cold fluid flow measurement and the thermal device flow measurement in combination, generating a second deviation signal indicating a deviation in the cold fluid conduit.

Accordingly, by using deviation signals indicating that the thermal energy circuit has been deviated may improve system maintenance, which in turn result in less down time for service. The earlier a signal may be transmitted when a deviation has occurred, the earlier a system insufficiency causing the deviation can be solved.

The first deviation signal may indicate a leakage in the hot fluid conduit.

The second deviation signal may indicate a leakage in the cold fluid conduit.

The first deviation signal may be generated upon the difference between the first hot fluid flow measurement and the second hot fluid flow measurement combined with the thermal device flow measurement is above a first threshold.

The second deviation signal may be generated upon the difference between the first cold fluid flow measurement and the second cold fluid flow measurement combined with the thermal device flow measurement is above a second threshold. The second threshold and first threshold may be different. The second threshold and first threshold may be the same.

Upon the first hot fluid flow measurement is different from the second hot fluid flow measurement and the thermal device flow measurement in combination and upon the first cold fluid flow measurement is different from the second cold fluid flow measurement and the thermal device flow measurement in combination, a third deviation signal may be generated. The third deviation signal indicating a deviation in both the hot fluid conduit and the cold fluid conduit. The third deviation signal may indicate a detection of an unauthorized thermal device. Hence, by studying the different deviation signals it may be determined whether there is a leakage in the cold fluid conduit, a leakage in the hot fluid conduit or an unauthorized connection. Accordingly, the type of deviation may be determined.

The third deviation signal may be generated upon the difference between the first hot fluid flow measurement and the second hot fluid flow measurement combined with the thermal device flow measurement is above a third threshold and upon the difference between the first cold fluid flow measurement and second cold fluid flow measurement combined with the thermal device flow measurement is above a fourth threshold. The third threshold and the first threshold may be the same. The third threshold and the first threshold may be the different. The fourth threshold and the second threshold may be the same. The fourth threshold and the second threshold may be the different.

The method may further comprise determining a deviation location based on flow sensor positions of the first and second hot fluid flow sensors and/or flow sensor positions of the first and second cold fluid flow sensors.

Hence, the location of the leakage or unauthorized connection may be determined. Accordingly, the leakage or unauthorized connection may be found fast. This may reduce a downtime for the thermal energy circuit.

According to a second aspect, it is provided a server for identifying a deviation of a combined district heating and cooling system. The server comprising a transceiver and a control circuit. The transceiver is configured to: receive a first hot fluid flow measurement from a first hot fluid flow sensor arranged in a hot fluid conduit in the combined district heating and cooling system; receive a first cold fluid flow measurement from a first cold fluid flow sensor arranged in a cold fluid conduit in the combined district heating and cooling system; receive a second hot fluid flow measurement from a second hot fluid flow sensor arranged in the hot fluid conduit upstream the first hot fluid flow sensor; receive a second cold fluid flow measurement from a second cold fluid flow sensor arranged in the cold fluid conduit downstream the first cold fluid flow sensor; and receive a thermal device flow measurement from a thermal device flow sensor configured to measure the thermal device flow of a thermal device connected to the hot fluid conduit downstream the first hot fluid flow sensor and upstream the second hot fluid flow sensor, and to the cold fluid conduit upstream the first cold fluid flow sensor and downstream the second cold fluid flow sensor. The thermal device flow of the thermal device is a flow either from the cold conduit across the thermal device to the hot conduit or from the hot conduit across the thermal device to the cold conduit. The control circuit is configured to: execute a hot fluid flow comparison function configured to compare the first hot fluid flow measurement with a combination of the second hot fluid flow measurement and the thermal device flow measurement and upon determination of a mismatch therebetween generate a first deviation signal, and execute a cold fluid flow comparison function configured to compare the first cold fluid flow measurement with a combination of the second cold fluid flow measurement and the thermal device flow measurement and upon determination of a mismatch therebetween generate a second deviation signal.

The control circuit may further be configured to execute a deviation location determination function configured to determine a location of the deviation. The deviation location determination function may be configured to determine the location of the deviation based on flow sensor positions of the first and second hot fluid flow sensors and/or based on flow sensor positions of the first and second cold fluid flow sensors.

The above mentioned features of the method, when applicable, apply to this second aspect as well. In order to avoid undue repetition, reference is made to the above.

According to a third aspect, it is provided an arrangement of flow sensors configured to measure flows in a combined district heating and cooling system. The arrangement comprising: a first hot fluid flow sensor arranged in a hot fluid conduit in the combined district heating and cooling system and configured to measure a first hot fluid flow; a first cold fluid flow sensor arranged in a cold fluid conduit in the combined district heating and cooling system and configured to measure a first cold fluid flow; a second hot fluid flow sensor arranged in the hot fluid conduit upstream the first hot fluid flow sensor and configured to measure a second hot fluid flow measurement; a second cold fluid flow sensor arranged in the cold fluid conduit downstream the first cold fluid flow sensor and configured to measure a second cold fluid flow measurement; and a thermal device flow sensor configured to measure a thermal device flow of a thermal device connected to the hot fluid conduit downstream the first hot fluid flow sensor and upstream the second hot fluid flow sensor, and to the cold fluid conduit upstream the first cold fluid flow sensor and downstream the second cold fluid flow sensor. The thermal device flow of the thermal device is a flow either from the cold conduit across the thermal device to the hot conduit or from the hot conduit across the thermal device to the cold conduit.

The above mentioned features of the method, when applicable, apply to this third aspect as well. In order to avoid undue repetition, reference is made to the above.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described or steps of the methods described as such device and method may vary. It is also to be understood that the terminology used herein is for purpose of describing particular embodiments only, and is not intended to be limiting. It must be noted that, as used in the specification and the appended claim, the articles "a," "an," "the," and "said" are intended to mean that there are one or more of the elements unless the context clearly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTION OF THE DRAWINGS

These and other aspects of the present invention will now be described in more detail, with reference to the appended drawings showing embodiments of the invention. The figures are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments are the invention are shown. This invention may, however, be embodied in many different forms and should not be construed as limited to the embodiments set forth herein; rather, these embodiments are provided for thoroughness and completeness, and to fully convey the scope of the invention to the skilled person.

Figure 1:
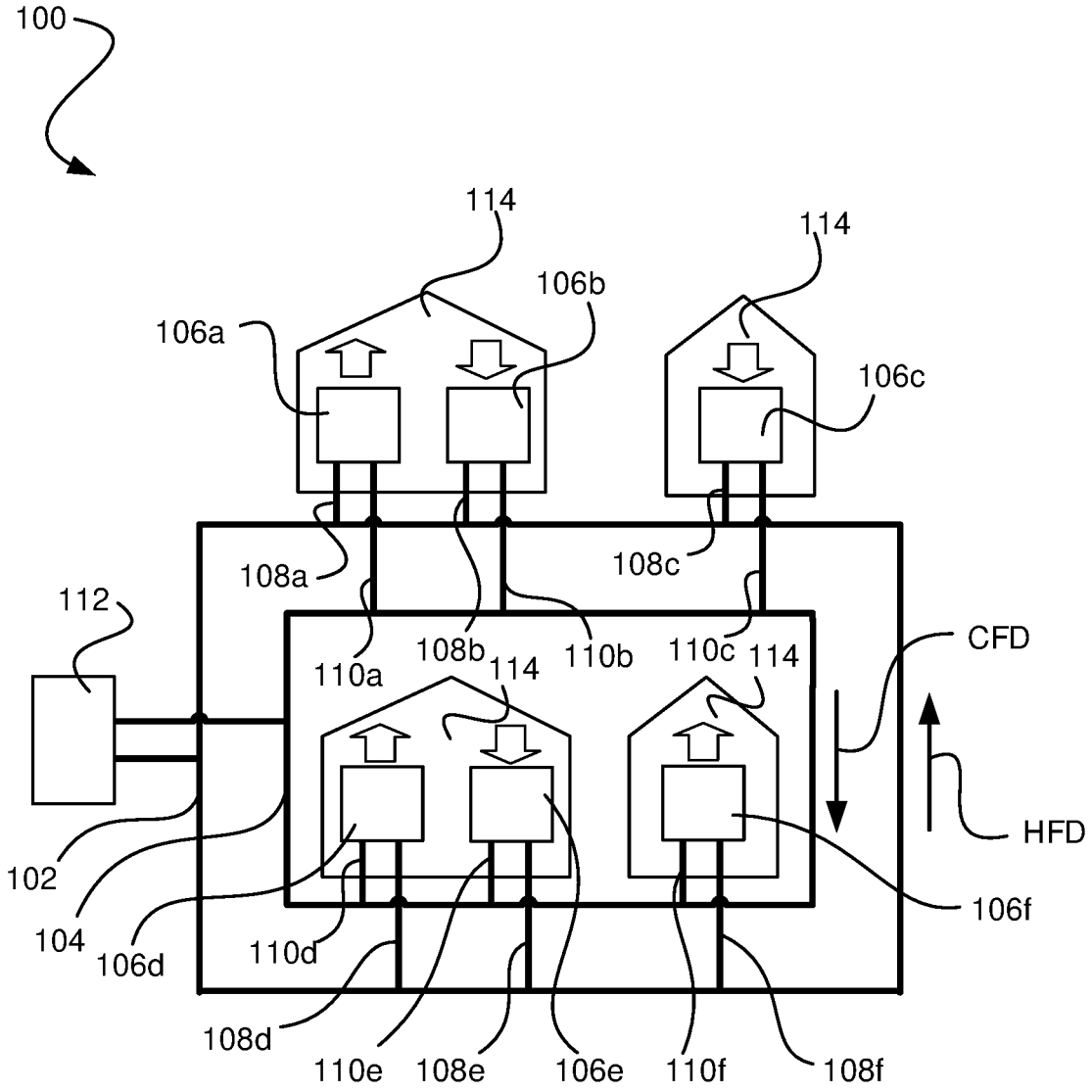
FIG. 1 is a schematic diagram of a combined district heating and cooling system.

FIG. 1 generally illustrates a combined district heating and cooling system 100. The system 100 can utilize heat pumps for energy efficient heating and/or cooling of buildings. As illustrated, the system 100 comprises a thermal energy circuit and a plurality of buildings 114. The plurality of buildings 114 can be thermally coupled to the thermal energy circuit, which can be arranged to circulate and store thermal energy in heat transfer fluid flowing through the thermal energy circuit.

By way of example, the heat transfer fluid comprises water. However, according to another example, other heat transfer fluids may be used. Some non-limiting examples are ammonia, oils, alcohols and anti-freezing fluids such as glycol. The heat transfer fluid may also comprise a mixture of two or more of the heat transfer fluids mentioned above.

The thermal energy circuit can comprise a hot fluid conduit 102 for transporting hot fluid in a hot fluid direction (HFD) and a cold fluid conduit 104 for transporting cold fluid in a cold fluid direction (CFD). The HFD may be opposite to the CFD.

The hot fluid conduit 102 can be configured to allow heat transfer fluid of a hot fluid temperature to flow there through. The cold fluid conduit 104 can be configured to allow heat transfer fluid of a cold fluid temperature to flow there through. The cold fluid temperature is lower than the hot fluid temperature.

The hot fluid conduit 102 and the cold fluid conduit 104 are separated. The hot fluid conduit 102 and the cold fluid conduit 104 may be arranged as closed loops of piping. The hot fluid conduit 102 and the cold fluid conduit 104 may be arranged as open loops of piping. The hot fluid conduit 102 and the cold fluid conduit 104 are fluidly interconnected at the plurality of buildings 114 for allowing of thermal energy transfer to and from the plurality of buildings 114. The differential pressure between heat transfer fluid of the hot fluid conduit 102 and heat transfer fluid of the cold fluid conduit 104 are allowed to vary over time. Especially, sometimes the pressure of heat transfer fluid of the hot fluid conduit 102 is higher than the pressure of heat transfer fluid of the cold fluid conduit 104 and other times it is vice versa.

The two fluid conduits 102, 104, of the thermal energy circuit may be formed by plastics, composite, concrete or metal pipes. By way of example, High Density Polyethylene (HDPE) pipes may be used. The pipes may be single wall pipes. The pipes may be un-insulated.

In this particular system, (in case the heat transfer liquid is water) the hot fluid temperature in the hot fluid conduit is in the range of 5-50, preferably 10-40 degrees Celsius and the cold fluid temperature in the cold fluid conduit is in the range of 1-45, preferably 5-35 degrees Celsius. The difference in temperature between the hot fluid temperature and the cold fluid temperature may be in the range of 1-25, preferably 2-15, more preferably 5-10 degrees Celsius.

The plurality of buildings 114 comprises a plurality of thermal devices 106*a-f*. Each thermal device 106*a-f* is connected to the hot fluid conduit 102 via hot fluid connection conduits 108*a-f* and to the cold fluid conduit 104 via cold fluid connection conduits 110*a-f*.

In order to balance the thermal energy within the combined district heating and cooling system 100, the system 100 may further comprise a thermal server plant 112. The thermal server plant 112 functions as an external thermal source and/or thermal sink. The function of the thermal server plant 112 is to maintain the temperature difference between the hot and cold fluid conduits 102, 104 of the thermal energy circuit. The function of the thermal server plant 112 is further to regulate the pressure difference between the hot and cold fluid conduits 102, 104 of the thermal energy circuit. The thermal devices 106*a-f* is categorized into local thermal energy consumer assemblies and local thermal energy generator assemblies. A local thermal energy consumer assembly is arranged to transfer thermal energy from heat transfer liquid of the thermal energy circuit to surroundings of the local thermal energy consumer assembly. This is achieved by transfer thermal energy from heat transfer liquid taken from the hot fluid conduit 102 to surroundings of the local thermal energy consumer assembly such that heat transfer liquid returned to the cold fluid conduit 104 has a temperature lower than the hot fluid temperature and preferably a temperature equal to the cold fluid temperature. A local thermal energy generator assembly is configured to transfer thermal energy from its surroundings to heat transfer liquid of the thermal energy circuit. This is achieved by transfer thermal energy from surroundings of the local thermal energy generator assembly to heat transfer liquid taken from the cold fluid conduit 104, such that heat transfer liquid returned to the hot fluid conduit 102 has a temperature higher than the cold fluid temperature and preferably a temperature equal to the hot fluid temperature.

Each building 114 comprises at least one of one or more local thermal energy consumer assemblies and one or more local thermal energy generator assemblies. Hence, each building comprises at least one local thermal energy consumer assembly or at least one local thermal energy generator assembly. One specific building 114 may comprise more than one local thermal energy consumer assembly. One specific building 114 may comprise more than one local thermal energy generator assembly. One specific building 114 may comprise both a local thermal energy consumer assembly and a local thermal energy generator assembly.

The one or more local thermal energy consumer assemblies may be installed in the buildings 114 as local heaters for different heating needs. As a non-limiting example, a local heater may be arranged to deliver space heating or hot tap water preparation. Alternatively, or in combination, the local heater may deliver pool heating or ice- and snow purging. Hence, the local thermal energy consumer assembly is arranged for deriving heat from heat transfer fluid of the hot fluid conduit 102 and creates a cooled heat transfer fluid flow into the cold fluid conduit 104. Hence, the local thermal energy consumer assembly fluidly interconnects the hot and cold fluid conduits 102, 104, such that hot heat transfer fluid can flow from the hot fluid conduit 102 through the local thermal energy consumer assembly and then into the cold fluid conduit 104 after thermal energy in the heat transfer fluid has been consumed by the local thermal energy consumer assembly. The local thermal energy consumer assembly operates to draw thermal energy from the hot fluid conduit 102 to heat the_buildings 114 and then deposits the cooled heat transfer fluid into the cold fluid conduit 104.

The one or more local thermal energy generator assemblies may be installed in different buildings 114 as local coolers for different cooling needs. As an on-limiting example a local cooler may be arranged to deliver space cooling or cooling for freezers and refrigerators. Alternatively, or in combination, the local cooler may deliver cooling for ice rinks and ski centers or ice- and snow making. Hence, the local thermal energy generator assembly is deriving cooling from heat transfer fluid of the cold fluid conduit 104 and creates a heated heat transfer fluid flow into the hot fluid conduit 102. Hence, the local thermal energy generator assembly fluidly interconnects the hot and cold fluid conduits 102, 104, such that cold heat transfer fluid can flow from the cold fluid conduit 104 through the local thermal energy generator assembly and then into the hot fluid conduit 102 after thermal energy has been generated into the heat transfer fluid by the local thermal energy generator assembly. The local thermal energy generator assembly operates to extract heat from the plurality of buildings 114 to cool the plurality of buildings 114 and deposits that extracted heat into the hot fluid conduit 102.

The local thermal energy consumer assembly is selectively connected to the hot fluid conduit 102 via a valve and a pump. Depending on the differential pressure between heat transfer fluid of the hot fluid conduit 102 and heat transfer fluid of the cold fluid conduit 104 sometimes heat transfer fluid from the hot fluid conduit 102 needs to flow into the local thermal energy consumer assembly and other times heat transfer fluid from the hot fluid conduit 102 needs to be pumped into the local thermal energy consumer assembly. Upon selecting the connection of the local thermal energy consumer assembly to the hot fluid conduit 102 to be via the valve, heat transfer fluid from the hot fluid conduit 102 is allowed to flow into the local thermal energy consumer assembly. Upon selecting the connection of the local thermal energy consumer assembly to the hot fluid conduit 102 to be via the pump, heat transfer fluid from the hot fluid conduit 102 is pumped into the local thermal energy consumer assembly.

The local thermal energy generator assembly is selectively connected to the cold fluid conduit 104 via a valve and a pump. Depending on the differential pressure between heat transfer fluid of the hot fluid conduit 102 and heat transfer fluid of the cold fluid conduit 104 sometimes heat transfer fluid from the cold fluid conduit 102 needs to flow into the local thermal energy generator assembly and other times heat transfer fluid from the cold fluid conduit 104 needs to be pumped into the local thermal energy generator assembly. Upon selecting the connection of the local thermal energy generator assembly to the cold fluid conduit 104 to be via the valve, heat transfer fluid from the cold fluid conduit 104 is allowed to flow into the local thermal energy generator assembly. Upon selecting the connection of the local thermal energy generator assembly to the cold fluid conduit 104 to be via the pump, heat transfer fluid from the cold fluid conduit 104 is pumped into the local thermal energy generator assembly.

Figure 2A:
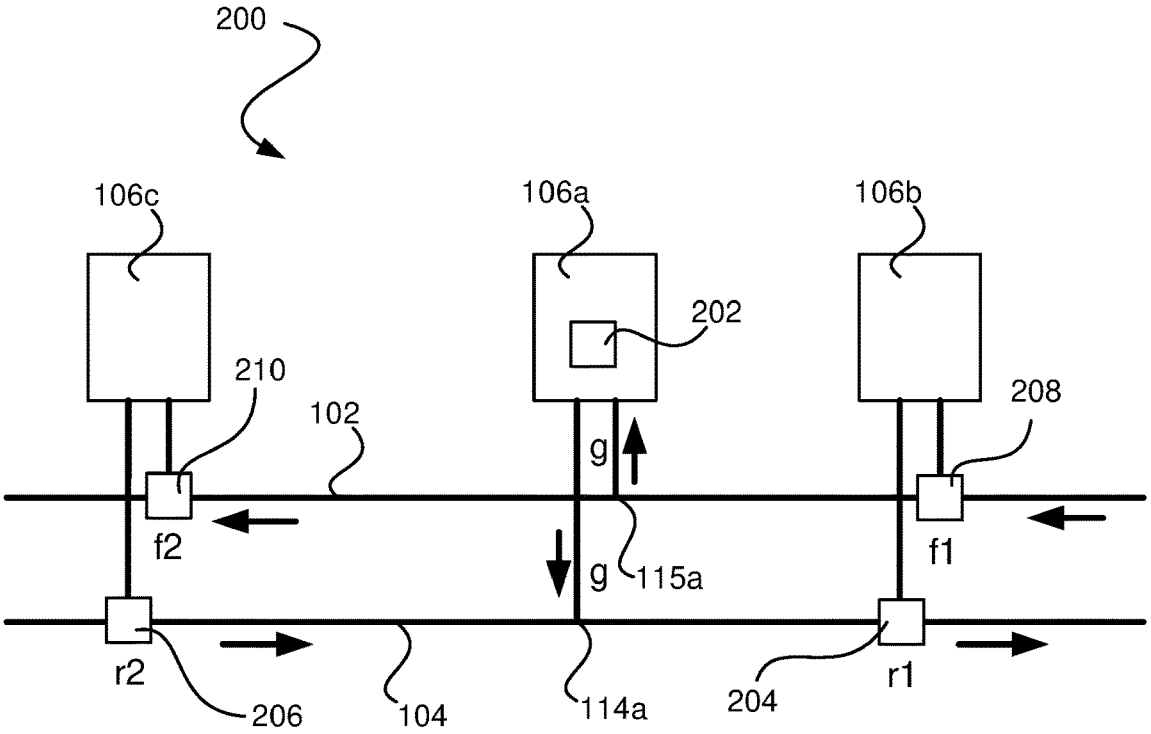
FIG. 2*a-d* illustrates different examples of thermal energy circuits in a combined district heating and cooling system.

By way of example, FIG. 2*a* illustrates a principle sketch of a section 200 of the combined district heating and cooling system 100. In this particular example, the combined district heating and cooling system 100 is in normal operation, i.e. without deviations.

In line with the combined district heating and cooling system 100 illustrated in FIG. 1, the section 200 comprises the hot fluid conduit 102 and the cold fluid conduit 104. Further, three different thermal devices 106*a*, 106*b*, 106*c* may be connected to the hot and cold fluid conduits 102, 104.

Further, the combined district heating and cooling system 100 comprises at least five flow sensors 202, 204, 206, 208, 210. Respective flow sensor 202, 204, 206, 208, 210, comprises a flow meter configured to measure a flow through the pipe wherein the flow meter is arranged. The flow meter is configured to measure a direction of the flow and an amount of liquid flowing through the flow meter per unit time. Respective flow sensor 202, 204, 206, 208, 210 may further comprise a control unit. Not all flow sensors need to comprise a dedicated control unit, two or more flow sensors may be controlled by the same control unit. A first flow sensor 202 is positioned in connection with a first thermal device 106*a*. The first flow sensor 202 may be positioned in the first thermal device 106*a*. The first flow sensor 202 is configured to measure an inflow and/or an outflow of the first thermal device 106*a*. The measured inflow and/or outflow of the first thermal device 106*a* may be referred to as a thermal device flow g. The first flow sensor 202 may be referred to as a thermal device flow sensor. A second flow sensor 204 is configured to measure a first cold flow r1 in the cold fluid conduit 104. The second flow sensor 204 is arranged at a first side of a connection 114*a* between the first thermal device 106*a* and the cold fluid conduit 104. The second flow sensor 204 may be arranged in the cold fluid conduit 104. The second flow sensor 204 may be arranged in vicinity of a second thermal device 106*b*. The second flow sensor 204 may be referred to as a first cold fluid flow sensor. A third flow sensor 206 is configured to measure a second cold flow r2 in the cold fluid conduit 104. The third flow sensor 206 is arranged at a second side, opposite the first side, of the connection 114*a* between the first thermal device 106*a* and the cold fluid conduit 104. The third flow sensor 206 may be arranged in the cold fluid conduit 104. The third flow sensor 206 may be arranged in the cold fluid conduit 104 downstream the second flow meter 204. The third flow sensor 206 may be arranged in vicinity of a third thermal device 106*c*. The third flow sensor 206 may be referred to as a second cold fluid flow sensor. A fourth flow sensor 208 is configured to measure a first hot flow f1 in the hot fluid conduit 102. The fourth flow sensor 208 is arranged at a first side of a connection 115*a* between the first thermal device 106*a* and the hot fluid conduit 102. The fourth flow sensor 208 may be arranged in the hot fluid conduit 102. The fourth flow sensor 208 may be arranged in vicinity of the second thermal device 106*b*. The fourth flow sensor 208 may be referred to as a first hot fluid flow sensor. A fifth flow sensor 210 is configured to measure a second hot flow f2 in the hot fluid conduit 102. The fifth flow sensor 210 is arranged at a second side, opposite the first side, of the connection 115*a* between the first thermal device 106*a* and the hot fluid conduit 102. The fifth flow sensor 210 may be arranged in the hot fluid conduit 102. The fifth flow sensor 210 may be arranged in the hot fluid conduit 102 upstream the fourth flow meter 208. The fifth flow sensor 210 may be arranged in vicinity of the third thermal device 106*c*. The fifth flow sensor 210 may be referred to as a second hot fluid flow sensor.

Flow measurements f1, f2, r1, r2, g, can be obtained via the flow sensors 202, 204, 206, 208, 210. The flow measurements may be transferred to a server. The measurements may be transferred via a wired or wireless connection. By analyzing the flow measurements f1, f2, r1, r2, g, the server may be configured to determine a deviation in the combined district heating and cooling system 100. The analysis may be made by software run on a processor of the server. The server may be a single server device. According to one example, one of the control units of a flow sensor may form the server. Alternatively, the server may be distributed over a plurality of devices. According to one example, control units of the respective flow meter may form part of the distributed server.

Hot fluid flow comparisons between the different flow measurements f1, f2, g, in the hot fluid conduit 102 can be made in the server. Further, cold fluid flow comparisons between the flow measurements r1, r2, g, in the cold fluid conduit 104 can be made in the server. The flow measurements used for the comparisons may be average flow measurements of each flow f1, f2, r1, r2, g.

Based on these comparisons, the server may determine whether there is a deviation in the combined district heating and cooling system 100. Examples of deviations are a leakage or an unauthorized connection to the combined district heating and cooling system 100 as explained below in further detail.

A hot fluid flow comparison in the hot fluid conduit 102 in a normal operation is f1=f2+g.

A cold fluid flow comparison in the cold fluid conduit 104 in a normal operation is r1=r2+g.

In a normal operation, as illustrated in FIG. 2*a*, both of the fluid flow comparisons are fulfilled. The hot fluid flow comparison in the normal operation may be a hot fluid flow reference comparison 212. The cold fluid flow comparison in the normal operation may be a cold fluid flow reference comparison 214.

Figure 2B:
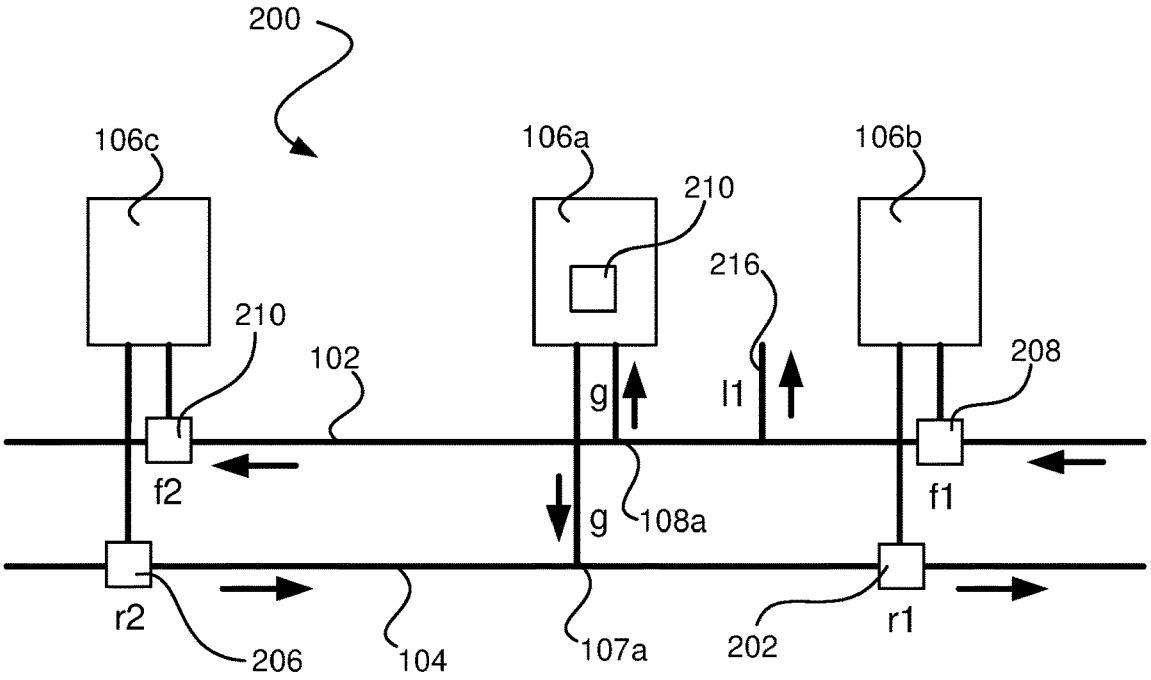

In FIG. 2*b*, it is illustrated a principle sketch of the section 200 of the combined district heating and cooling system 100 where a leakage 216 has occurred. In this particular example, the leakage 216 of the combined district heating and cooling system 100 has occurred in the hot fluid conduit 102.

Due to the leakage 216 in the hot fluid conduit 102, the hot fluid flow reference comparison 212 for the hot fluid conduit 102 will not be fulfilled. The hot fluid flow comparison is in this example namely f1=f2+g+I1 218, wherein I1 is the hot flow leakage 216. Hence, there is a mismatch between the hot fluid flow reference comparison 212 and the present hot fluid flow comparison 218.

The cold fluid flow reference comparison 214 for the cold fluid conduit 104 will still be fulfilled, since there is nothing that differs from the normal operation for the cold fluid conduit 104. Hence, the is a match between the cold fluid flow reference comparison 214 and the present cold fluid flow comparison 220.

Upon a mismatch in the hot fluid conduit 102 is determined, a first deviation signal may be generated. The first deviation signal is indicating a deviation in the hot fluid conduit 102. The first deviation signal may be transferred from the server to an operator such that the deviation can be taken care of. The first deviation signal is indicative of a leakage in the hot fluid conduit 102.

Figure 2C:
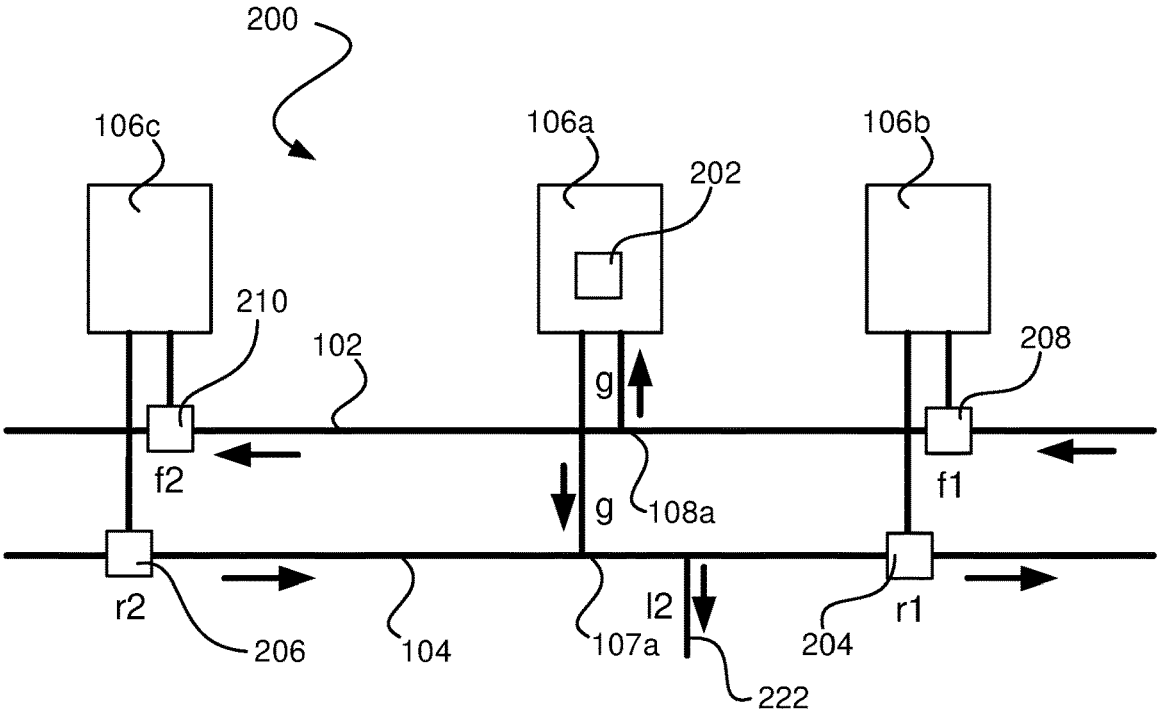

In FIG. 2*c*, it is illustrated a principle sketch of a section 200 of the combined district heating and cooling system 100 where a leakage 222 has occurred in the cold fluid conduit 104.

Due to the leakage 222 in the cold fluid conduit 104, the cold fluid flow reference comparison 214 for the cold fluid conduit 104 will not be fulfilled. The cold fluid flow comparison is in this example is namely r1=r2+g+I2 224, wherein 12 is the cold flow leakage 222. Hence, there is a mismatch between the cold fluid flow reference comparison 214 and the present cold fluid flow comparison 224.

The hot fluid flow reference comparison 212 for the hot fluid conduit 102 will still be fulfilled, since there is nothing that differs from the normal operation for the hot fluid conduit 102. Hence, there is a match between the hot fluid flow reference comparison 212 and the present hot fluid flow comparison 226.

Upon a mismatch in the cold fluid conduit 104 is determined, a second deviation signal may be generated. The second deviation signal is indicating a deviation in the cold fluid conduit 104. The second deviation signal may be transferred from the server to the operator. The second deviation signal is indicative of a leakage in the cold fluid conduit 104.

Figure 2D:
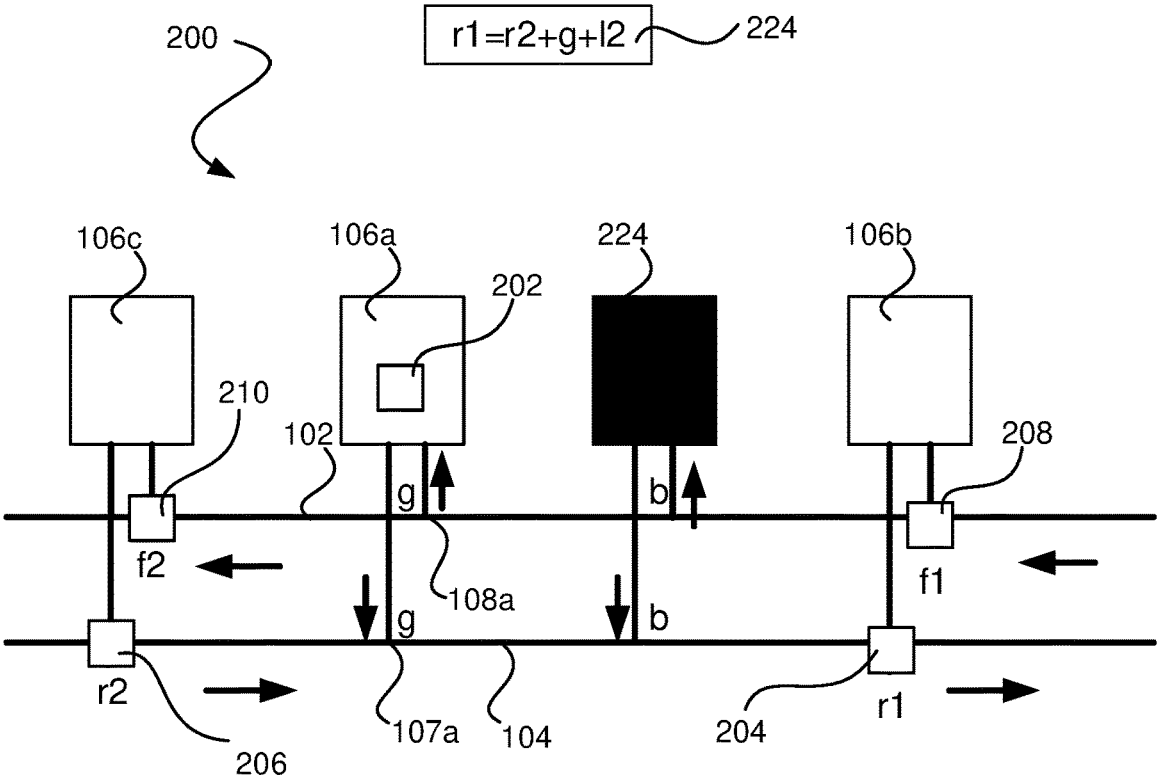

In FIG. 2*d*, it is illustrated a principle sketch of the section 200 where an unauthorized thermal device 224 is connected to the combined district heating and cooling system 100. In this particular example, the unauthorized thermal device 224 is a heat pump, wherein the unauthorized thermal device 224 is using the hot fluid from the hot fluid conduit 102 to generate heat and transport the cooled fluid to the cold fluid conduit 104.

Due to the unauthorized thermal device 224 neither the hot fluid flow reference comparison 212 for the hot fluid conduit 102 nor the cold fluid flow reference comparison 214 for the cold fluid conduit 104 are fulfilled. The hot fluid flow comparison is in this example f1=f2+g+b 228, wherein b is the flow into the unauthorized thermal device 224. Hence, there is a mismatch between the hot fluid flow reference comparison 212 and the present hot fluid flow comparison 228. The cold fluid flow comparison is in this example r1=r2+g+b 230, wherein b is the flow out from the unauthorized thermal device 224. Hence, there is a mismatch between the cold fluid flow reference comparison 214 and the present cold fluid flow comparison 230.

When both of the fluid flow comparisons Upon a mismatch for both the hot and cold conduits 102, 104 occur, a third deviation signal may be generated. The third deviation signal is indicating a deviation in both the hot fluid conduit 102 and in the cold fluid conduit 104. This may be indicative of that an unauthorized thermal device 224 has been connected to the system, this may be referred to as an infringement. Herein, the unauthorized thermal device 224 is a non-registered thermal device, thus, a thermal device that does not belong to the original installation of the combined district heating and cooling system 100. The third deviation signal may be transferred from the server to an operator such that the deviation can be taken care of.

If deviation has occurred in the combined district heating and cooling system 100, a deviation location may be determined. Herein, the deviation location is a location where the deviation takes place in the thermal energy circuit.

The deviation location may be determined based on positions for the at least five flow sensors 202, 204, 206, 208, 210 are known and also how these are positioned in relation to each other.

For example, the first deviation signal may indicate that the deviation is located between the fourth and fifth flow sensors 208, 210. Further, the second deviation signal may indicate that the deviation is located between the second and third flow sensors 204, 206. Moreover, the third deviation signal may indicate that the deviation is located between the second and third flow sensors 204, 206 and the fourth and fifth flow sensors 204, 206.

By using the fluid flow comparisons in combination with flow sensor positions it may be much easier to find the deviation and further solve the problem with the deviation. It will facilitate to find out that a deviation has occurred and further finding the insufficiency causing the deviation.

Figure 3:
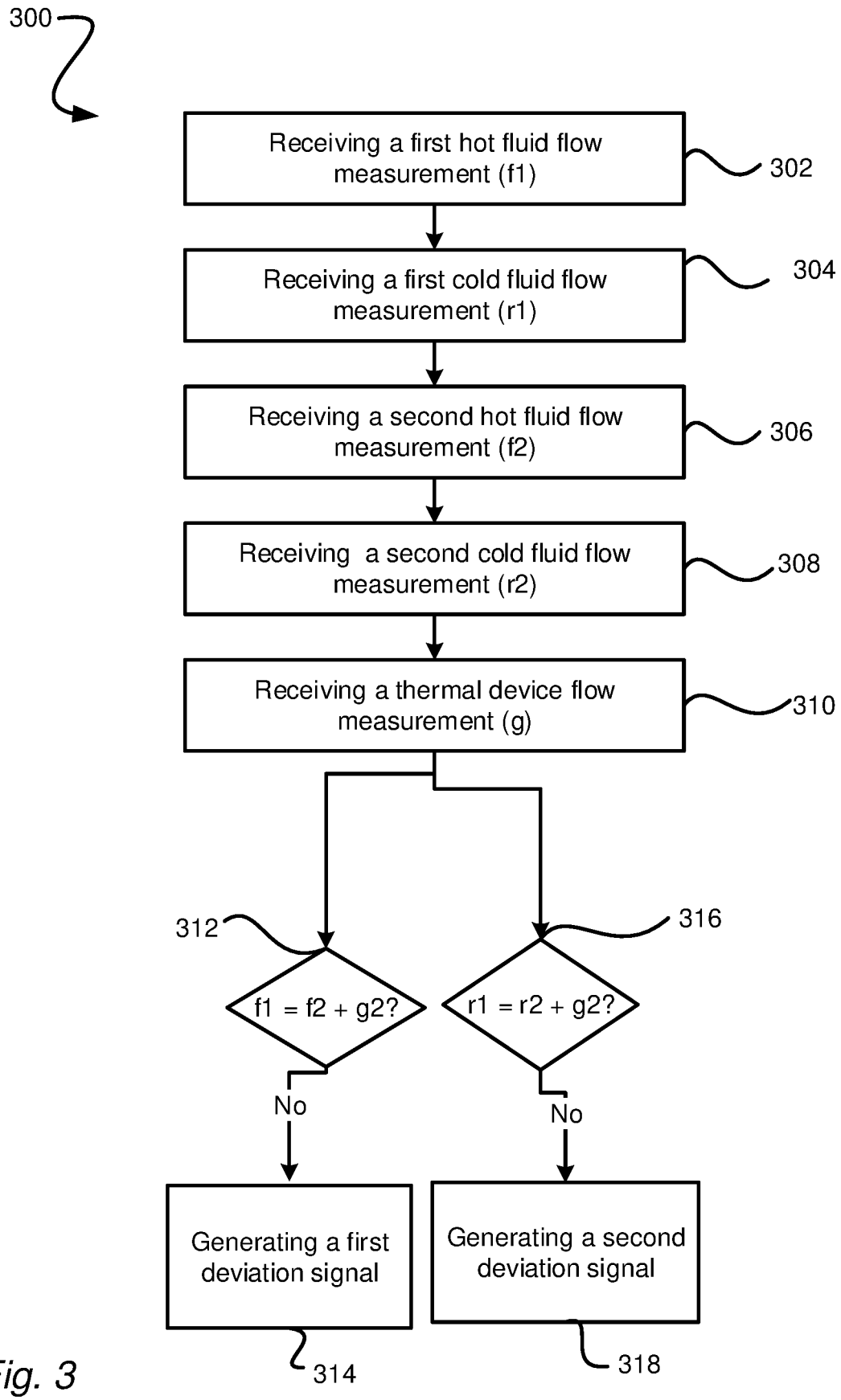
FIG. 3 is a block diagram for identifying a deviation of a combined district heating and cooling system.

In connection with FIG. 3, a flowchart illustrating a method 300 for identifying a deviation of the combined district heating and cooling system 100 is illustrated. The method 300 comprises the following acts: receiving 302 a first hot fluid flow measurement f1; receiving 304 a first cold fluid flow measurement r1; receiving 306 a second hot fluid flow measurement f2; receiving 308 a second cold fluid flow measurement r2; receiving 310 a thermal device flow measurement g. Prior to receiving each specific flow measurement f1, f2, r1, r2, g, each specific flow measurement f1, f2, r1, r2, g may be determined. Hence, the method may further comprise determining each specific flow measurement f1, f2, r1, r2, g. Each specific flow measurement f1, f2, r1, r2, g may be determined by a corresponding flow sensor, 202, 204, 206, 208, 210. Further, each specific flow measurement f1, f2, r1, r2, g may be an averaged flow measurement. The averaging may be made over a time period of a second. The averaging may be made over a time period of a minute. The averaging may be made over a time period of an hour. Moreover, each specific flow measurement f1, f2, r1, r2, g may be a volume flow measurement. Any such volume flow measurement may be transformed to a signal indicative of a mass flow.

The method may further comprise comparing 312 the first hot fluid flow measurement f1 with the second hot fluid flow measurement f2 and the thermal device flow measurement g in combination. Upon a mismatch between the first hot fluid flow measurement f1 and the second hot fluid flow measurement f2 combined with the thermal device flow measurement g is found generating the first deviation signal 314. Optionally, the first deviation signal may be generated only upon a difference between the first hot fluid flow measurement f1 and the second hot fluid flow measurement f2 combined with the thermal device flow measurement g is above a predetermined first threshold.

Further, the method may comprise comparing 316 the first cold fluid flow measurement r1 with the second cold fluid flow measurement r2 and the thermal device flow measurement g in combination. Upon a mismatch between the first cold fluid flow measurement r1 and the second cold fluid flow measurement r2 combined with the thermal device flow measurement g is found, generating the second deviation signal 318. Optionally, the second deviation signal may be generated only upon a difference between the first cold fluid flow measurement r1 and the second cold fluid flow measurement r2 combined with the thermal device flow measurement g is above a predetermined second threshold. The second threshold may be different from the first threshold. The second threshold may be the same as the first threshold.

The method may further comprise, upon the first hot fluid flow measurement f1 is different from the second hot fluid flow measurement f2 and the thermal device flow measurement g in combination and upon the first cold fluid flow measurement r1 is different from the second cold fluid flow measurement r2 and the thermal device flow measurement g in combination, generating the third deviation signal.

By way of example, the generated first, second and/or third deviation signal may be a visual alarm, a sound alarm or a text alarm.

The method may further comprise determining a deviation location. The determination of the deviation location may be based on flow sensor positions of the first and second hot fluid flow sensors 208, 210 and/or flow sensor positions of the first and second cold fluid flow sensors 204, 206.

Figure 4:
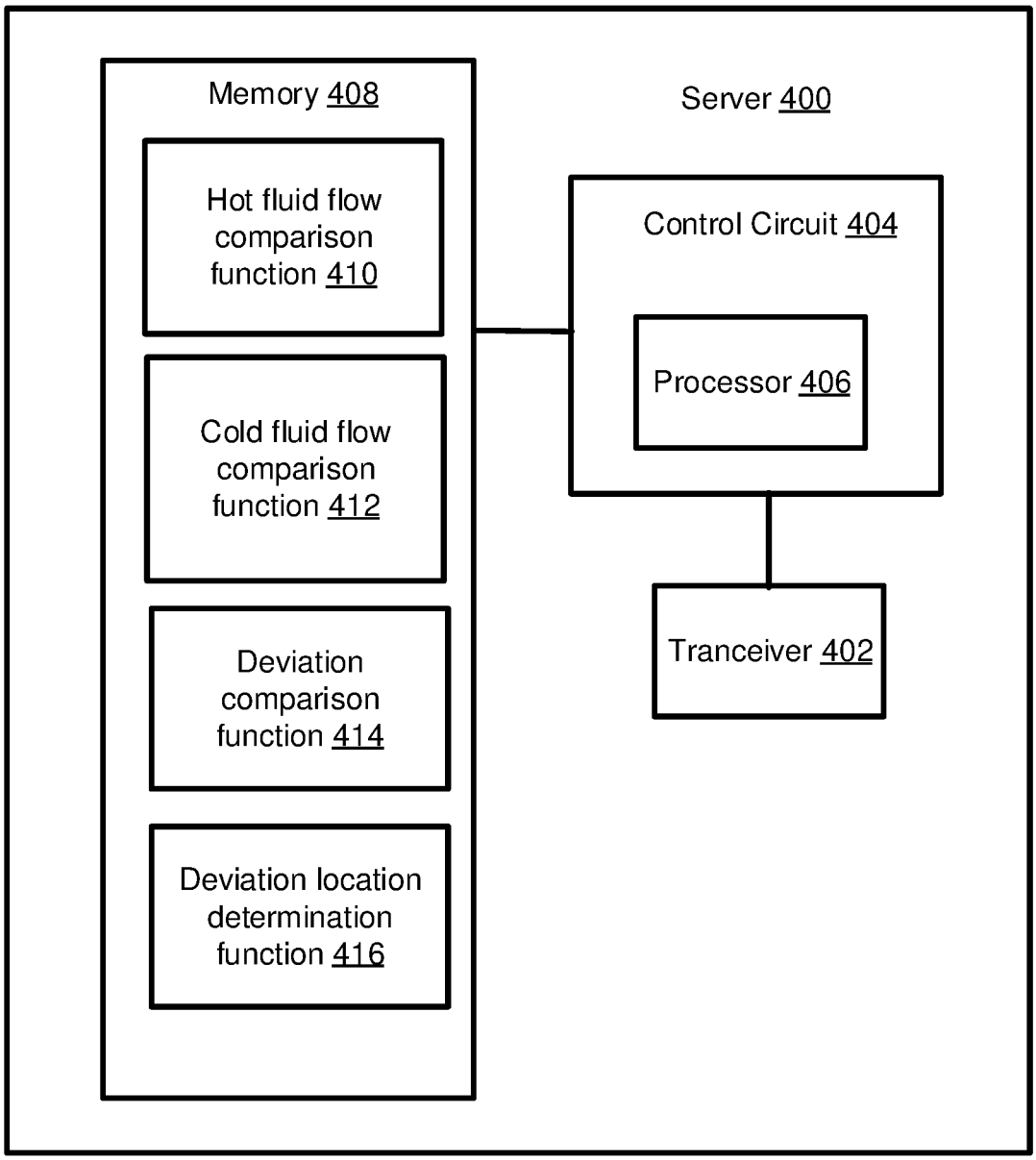
FIG. 4 is a schematic of a server configured to identify a deviation of a combined district heating and cooling system of FIG. 1.

In connection with FIG. 4 a schematic of the server 400 configured to receive and analyze the flow measurements f1, f2, r1, r2, g will be discussed. The server 400 comprises a transceiver 402, a control circuit 404 and a memory 408.

The transceiver 402 is configured to communicate with the flow sensors 202, 204, 206, 208, 210. Hence, the transceiver 402 enables the server 400 to establish communications with other device, such as the flow sensors 202, 204, 206, 208, 210. That said, the flow sensors 202, 204, 206, 208, 210 also comprises a respective transceiver for communicating with the server 400. The communications may include data transfers, and the like. Data transfers may include, but are not limited to, downloading and/or uploading data and receiving or sending messages. The data may be processed by the server 400 and/or the flow sensors 202, 204, 206, 208, 210. The processing may include storing the data in a memory, e.g. the memory 408 of the server 400, executing operations or function, and so forth.

The control circuit 404 is configured to carry out overall control of functions and operations of the server 400. The control circuit 404 may include a processor 406, such as a central processing unit (CPU), microcontroller, or microprocessor. The processor 406 is configured to execute program code stored in the memory 408, in order to carry out functions and operations of the server 400.

The memory 408 may be one or more of a buffer, a flash memory, a hard drive, a removable media, a volatile memory, a non-volatile memory, a random access memory (RAM), or another suitable device. In a typical arrangement, the memory 408 may include a non-volatile memory for long term data storage and a volatile memory that functions as system memory for the control circuit 404. The memory 408 may exchange data with the control circuit 404 over a data bus. Accompanying control lines and an address bus between the memory 408 and the control circuit 404 also may be present.

Functions and operations of the server 400 may be embodied in the form of executable logic routines (e.g., lines of code, software programs, etc.)

that are stored on a non-transitory computer readable medium (e.g., the memory 408) of the server 400 and are executed by the control circuit 404 (e.g., using the processor 406). Furthermore, the functions and operations of the server 400 may be a stand-alone software application or form a part of a software application that carries out additional tasks related to the server 400. The described functions and operations may be considered a method that the corresponding device is configured to carry out. Also, while the described functions and operations may be implemented in software, such functionality may as well be carried out via dedicated hardware or firmware, or some combination of hardware, firmware and/or software.

The control circuit 404 may execute a hot fluid flow comparison function 410. The hot fluid flow comparison function 410 is configured to compare the first hot fluid flow measurement f1 with a combination of the second hot fluid flow measurement f2 and the thermal device flow measurement g. Upon a mismatch between the first hot fluid flow and the combination of the second hot fluid flow measurement f2 and the thermal device flow measurement g is found, the hot fluid flow comparison function 410 is configured to generate the first deviation signal discussed above in connection with FIG. 2*b*.

The control circuit 404 may execute a cold fluid flow comparison function 412. The cold fluid flow comparison function 412 is configured to compare the first cold fluid flow measurement r1 with a combination of the second cold fluid flow measurement r2 and the thermal device flow measurement g. Upon a mismatch between the first cold fluid flow r1 and the combination of the second cold fluid flow measurement f2 and the thermal device flow measurement g is found, the cold fluid flow comparison function 412 is configured to generate the second deviation signal discussed above in connection with FIG. 2*c*.

The control circuit 404 may execute a deviation comparison function 414. The deviation comparison function 414 is configured to, upon the first deviation signal is generated and upon the second deviation signal is generated, generate the third deviation signal as discussed above in connection with FIG. 2*d*.

Upon generated, the server 400 may be configured to communicate the first, second and/or third deviation signal to an operator of the combined district heating and cooling system 100.

The control circuit 404 may execute a deviation location determination function 416. The deviation location determination function 416 is configured to determine a location of the deviation. The deviation location determination function 416 may be configured to determine the location of the deviation based on flow sensor positions of the first and second hot fluid flow sensors 208, 210. Additionally, or in combination, the deviation location determination function 416 may be configured to determine the location of the deviation based on flow sensor positions of the first and second cold fluid flow sensors 204, 206.

The person skilled in the art realizes that the present invention by no means is limited to the preferred embodiments described above. On the contrary, many modifications and variations are possible within the scope of the appended claims.

For example, above one thermal device flow measurement g from one thermal device flow sensor 202 of one thermal device 106*a* connected to the hot fluid conduit 102 downstream the first hot fluid flow sensor 208 and upstream the second hot fluid flow sensor 210, and connected to the cold fluid conduit 104 upstream the first cold fluid flow sensor 204 and downstream the second cold fluid flow sensor 206 was discussed. It is however understood that more than one thermal device flow measurement g from more than one thermal device flow sensor 202 may be used.

Additionally, variations to the disclosed embodiments can be understood and effected by the skilled person in practicing the claimed invention, from a study of the drawings, the disclosure, and the appended claims.

The invention claimed is:

1. A method for identifying a deviation in a combined district heating and cooling system comprising a thermal energy circuit comprising a hot fluid conduit for transporting hot fluid, a cold fluid conduit for transporting cold fluid, and at least one thermal device connected to the hot fluid conduit via a hot fluid connection conduit and to the cold fluid conduit via a cold fluid connection conduit, wherein, during operation, the hot fluid is warmer than the cold fluid, said method comprising:

receiving a first hot fluid flow measurement from a first hot fluid flow sensor arranged in the hot fluid conduit;

receiving a first cold fluid flow measurement from a first cold fluid flow sensor arranged in the cold fluid conduit;

receiving a second hot fluid flow measurement from a second hot fluid flow sensor arranged in the hot fluid conduit upstream the first hot fluid flow sensor;

receiving a second cold fluid flow measurement from a second cold fluid flow sensor arranged in the cold fluid conduit downstream the first cold fluid flow sensor; and receiving a thermal device flow measurement from a thermal device flow sensor configured to measure a thermal device flow of a thermal device connected to the hot fluid conduit downstream the first hot fluid flow sensor and upstream the second hot fluid flow sensor, and connected to the cold fluid conduit upstream the first cold fluid flow sensor and downstream the second cold fluid flow sensor, wherein the thermal device flow of the thermal device is a flow either from the cold conduit across the thermal device to the hot conduit or from the hot conduit across the thermal device to the cold conduit, wherein the method further comprises:

upon the first hot fluid flow measurement is different from the second hot fluid flow measurement and the thermal device flow measurement in combination, generating a first deviation signal indicating a deviation in the hot fluid conduit; and/or upon the first cold fluid flow measurement is different from the second cold fluid flow measurement and the thermal device flow measurement in combination, generating a second deviation signal indicating a deviation in the cold fluid conduit.

2. The method according to claim 1, wherein the first deviation signal indicates a leakage in the hot fluid conduit.

3. The method according to claim 1, wherein the second deviation signal indicates a leakage in the cold fluid conduit.

4. The method according to claim 1, wherein the first deviation signal is generated upon the difference between the first hot fluid flow measurement and the second hot fluid flow measurement combined with the thermal device flow measurement is above a first threshold.

5. The method according to claim 1, wherein the second deviation signal is generated upon the difference between the first cold fluid flow measurement and the second cold fluid flow measurement combined with the thermal device flow measurement is above a second threshold.

6. The method according to claim 1, wherein upon the first hot fluid flow measurement is different from the second hot fluid flow measurement and the thermal device flow measurement in combination and upon the first cold fluid flow measurement is different from the second cold fluid flow measurement and the thermal device flow measurement in combination, generating a third deviation signal indicating a deviation in both the hot fluid conduit and the cold fluid conduit.

7. The method according to claim 6, wherein the third deviation signal indicates a detection of an unauthorized thermal device.

8. The method according to claim 6, wherein the third deviation signal is generated upon the difference between the first hot fluid flow measurement and the second hot fluid flow measurement combined with the thermal device flow measurement is above a third threshold and upon the difference between the first cold fluid flow measurement and second cold fluid flow measurement combined with the thermal device flow measurement is above a fourth threshold.

9. The method according to claim 1, further comprising:

determining a deviation location based on flow sensor positions of the first and second hot fluid flow sensors and/or flow sensor positions of the first and second cold fluid flow sensors.

10. A server configured to identify a deviation of a combined district heating and cooling system, the server comprising a transceiver and a control circuit, wherein the transceiver configured to:

receive a first hot fluid flow measurement from a first hot fluid flow sensor arranged in a hot fluid conduit in the combined district heating and cooling system, receive a first cold fluid flow measurement from a first cold fluid flow sensor arranged in a cold fluid conduit in the combined district heating and cooling system, receive a second hot fluid flow measurement from a second hot fluid flow sensor arranged in the hot fluid conduit upstream the first hot fluid flow sensor, receive a second cold fluid flow measurement from a second cold fluid flow sensor arranged in the cold fluid conduit downstream the first cold fluid flow sensor, and receive a thermal device flow measurement from a thermal device flow sensor configured to measure a thermal device flow of a thermal device connected to the hot fluid conduit downstream the first hot fluid flow sensor and upstream the second hot fluid flow sensor, and connected to the cold fluid conduit upstream the first cold fluid flow sensor and downstream the second cold fluid flow sensor, wherein the thermal device flow of the thermal device is a flow either from the cold conduit across the thermal device to the hot conduit or from the hot conduit across the thermal device to the cold conduit; and wherein the control circuit is configured to execute a hot fluid flow comparison function configured to compare the first hot fluid flow measurement with a combination of the second hot fluid flow measurement and the thermal device flow measurement and upon determination of a mismatch therebetween generate a first deviation signal, and execute a cold fluid flow comparison function configured to compare the first cold fluid flow measurement with a combination of the second cold fluid flow measurement and the thermal device flow measurement and upon determination of a mismatch therebetween generate a second deviation signal.

11. The server according to claim 10, wherein the control circuit is further configured to execute a deviation comparison function configured to, upon the first deviation signal is generated and upon the second deviation signal is generated, generate a third deviation signal.

12. The server according to claim 10, wherein the control circuit is further configured to execute a deviation location determination function configured to determine a location of the deviation.

13. The server according to claim 12, wherein the deviation location determination function is configured to determine the location of the deviation based on flow sensor positions of the first and second hot fluid flow sensors and/or based on flow sensor positions of the first and second cold fluid flow sensors.

* * * * *